United States Patent [19]

Olving

[11] 4,089,526

[45] May 16, 1978

[54] PIVOTING BALL GAME BOARD WITH GIMBAL CONTROL

[76] Inventor: Henrik C. Olving, 17703 Oakwood Dr., Spring Lake, Mich. 49456

[21] Appl. No.: 673,713

[22] Filed: Apr. 5, 1976

[51] Int. Cl.[2] ..... A63F 7/14

[52] U.S. Cl. ..... 273/110; 273/113

[58] Field of Search ..... 273/110, 113, 115

[56] References Cited

U.S. PATENT DOCUMENTS

| | | | |
|---|---|---|---|
| 3,384,374 | 5/1968 | Boothe | 273/110 |
| 3,751,038 | 8/1973 | O'Keefe | 273/110 |
| 3,764,138 | 10/1973 | Schild | 273/110 |

FOREIGN PATENT DOCUMENTS

| | | | |
|---|---|---|---|
| 1,081,381 | 1954 | France | 273/110 |
| 85,723 | 1965 | France | 273/110 |
| 451,220 | 1936 | United Kingdom | 273/110 |
| 1,016,200 | 1966 | United Kingdom | 273/118 |

*Primary Examiner*—Richard C. Pinkham
*Assistant Examiner*—Lawrence E. Anderson

[57] ABSTRACT

The invention provides a game played on an upper tray and scored on a lower tray. The upper tray is supported on gimbals and is manipulated by the player through a single handle to induce a ball to move by gravity along a prescribed path. Numerous holes, large enough to pass the ball, are provided along and adjacent to the path to drop the ball onto the scoring tray if the player fails to keep the ball on the path. The lower tray is inclined to urge the ball to roll to a score determining position. Because the tray is a planar surface free of obstructions, the spin of the ball as it contacts the tray may bias it to one side or the other, affecting the score and introducing a certain element of chance into the game.

1 Claim, 6 Drawing Figures

PIVOTING BALL GAME BOARD WITH GIMBAL CONTROL

FIELD OF THE INVENTION

Games of skill or chance or a mixture of both are very old. For some time a game of dexterity has been popular, involving the use of a tray having raised sides, a ball and a plurality of pockets into which the ball can be partially received. The depth of the pockets is sufficient to trap the ball. Normally this game has a line marking the path the ball must trace to satisfy the requirements of the game as the ball moves from start to the indicated finish position. The pockets are located at strategic points along the ball's path to trap the ball if the player fails to so manipulate the ball that it follows the prescribed path. The tray is held in both hands and by manipulating the tray to tilt it about two axes, normal to each other, the ball is caused to move by gravity and hopefully to follow the prescribed path. Failure to follow the path will result in the ball being trapped in one of the "along-the-way pockets" for a substantially reduced score, if any.

BRIEF DESCRIPTION OF THE INVENTION

This invention provides means for substantially increasing the skill required to attain a good score and for all practical purposes eliminates the possibility of obtaining a perfect score except by skill. The invention provides a game requiring a significantly higher level of skill and alertness. It does, however, except for the perfect score, introduce an element of chance into the overall scoring for each player, thus providing a challenge even to the most practiced player.

The invention accomplishes this by providing a tray having a playing surface which may be tilted about two 90° axes by an operator using a single lever. The ball being played can fall through any one of a number of holes to a tray below. This lower tray is inclined toward one edge and the scoring value assigned to the position along that edge where the ball comes to rest determines the player's score. Chance becomes a factor in determining the score if one does not reach the last hole.

DESCRIPTION OF THE PREFERRED EMBODIMENT

Figure 5:
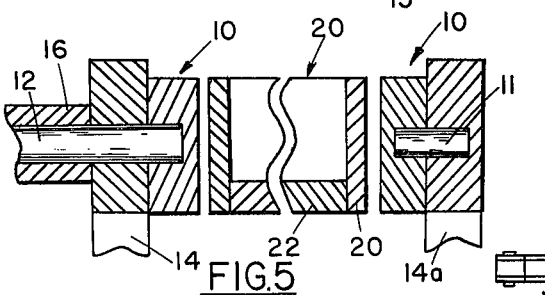
FIG. 5 is a fragmentary, enlarged, sectional view taken along the line V—V of FIG. 2.
Figure 4:
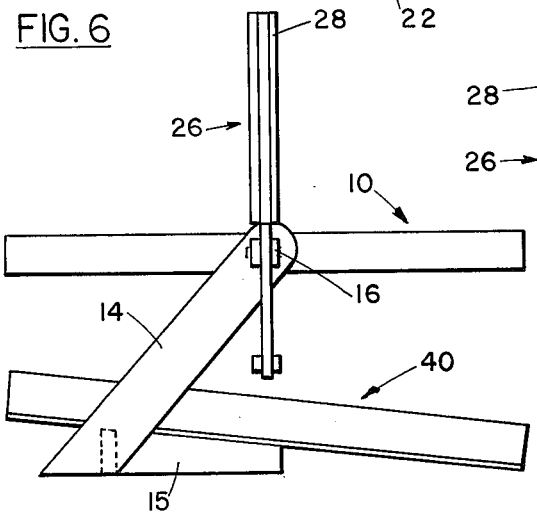
FIG. 4 is an end elevation view of the invention.

The numeral 10 refers to a rectangular frame pivotally mounted for fore and aft rocking movement about the pivot stub 11 and pivot shaft 12 (FIG. 5). The stub 11 and shaft 12 are supported on forwardly and upwardly inclined standards 14 and 14*a* which, in turn, are rigidly supported in spaced relationship and held against forward rocking motion by a base 15 (FIG. 4). The shaft 12 extends through its supporting standard 14 and is rotatable with respect to it. The outer end of the shaft 12 mounts the bifurcated handle support 16. The frame 10 has ends 17 and front and back sides 18 and 18*a*, respectively.

Figure 2:
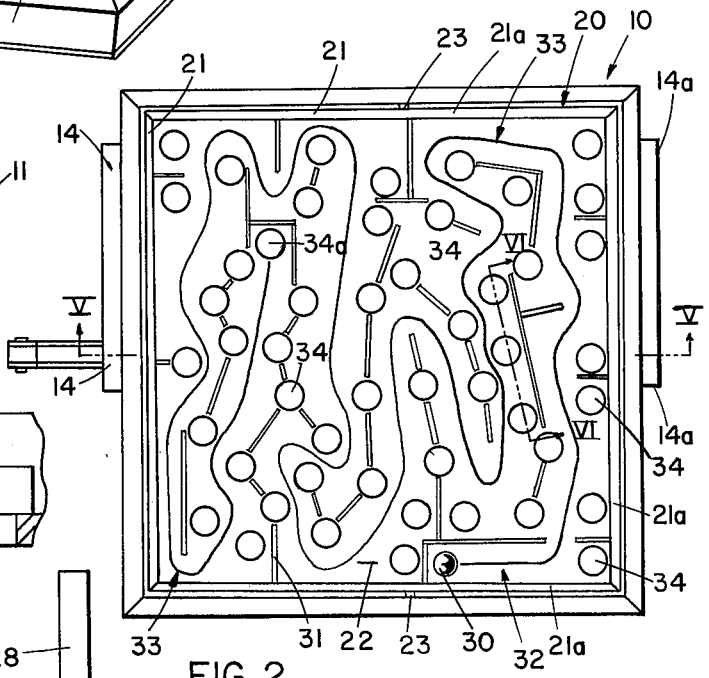
FIG. 2 is a plan view of the upper tray of the invention.

Seated within the frame 10 is a rectangular tray 20 having upstanding sides 21 and ends 21*a* and a bottom plate 22. The tray 20 is pivotally supported on the frame 10 by pivot pins 23 (FIG. 2). The pivot pins are located at the front and back of the tray and frame, midway between the ends. Thus, the tray is supported for lateral rocking movement within the frame.

The frame 10, the pivot stub 11, pivot shaft 12 and the pivot pins 23 constitute a support means for the tray 20 of the gimbals type permitting free inclination of the tray in any direction. In the preferred embodiment, the tray 20 and frame 10 are rectangular but this is not essential.

Figure 3:
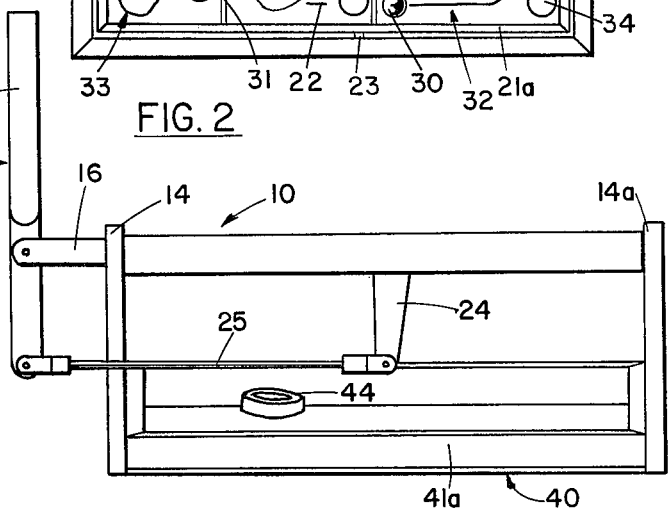
FIG. 3 is a front elevation view of the invention.

At the center of the tray 20, an actuator arm 24 is rigidly attached to the lower face of the tray and depends from it (FIG. 3). The lower end of the actuator arm 24 is pivotally connected to a rod 25. The other end of the rod 25 is pivotally connected to the depending end of the handle 26. The handle 26, at a point substantially remote from either end, is seated in the slot 27 formed by the bifurcated end of the handle support 16 and is pivotally attached to it. The upper portion of the handle is equipped with a suitable hand grip 28. The connections between the handle and the tray, irrespective of the direction of movement of the handle are close fits, substantially eliminating taper due to tolerance accumulation.

In the manner in which the handle 26, frame 10 and tray 20 are mounted, an operator, upon grasping the handle, can rock it back and forth thus tilting the frame and tray back and forth. At the same time, the operator, by rocking the handle laterally, can rock the tray laterally toward or away from the operator. Since a single handle controls both motions, the operator can readily shift the tray in any direction including compound movements such as making one corner the lowest point of the tray. By combining both attitude maneuvers in a single lever, requiring all manipulation by one hand only, the concentration required to successfully master the game is increased. Because of the game's design and construction, even very slight movements of the handle 26 in any direction are translated into significant changes in the attitude of the tray 20. Thus, while the use of a single handle for all maneuvering of the tray 20 simplifies the game at the same time it increases the necessity for concentration and precisiveness in both direction and magnitude of the operator's hand movement. Thus, not only is the game a more demanding challenge, it is an effective therapeutic method of increasing manual dexterity.

Figure 6:
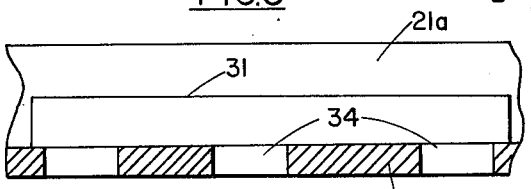
FIG. 6 is an enlarged, fragmentary, sectional view taken along the plane VI—VI of FIG. 2.

The top surface of the tray is designed to provide a support surface over which a ball 30 (FIG. 2) can be caused to move by gravity, the attitude of the tray controlling the direction and speed of the ball's movement. Movement of the ball 30 over the surface is controlled, hindered and to some extent guided, by raised barriers 31 (FIGS. 2 and 6). The barriers 31 are of various length and configurations. One set of barriers forms a pocket 32 which constitutes the starting point for the ball 30. The path the ball should follow is indicated by a line 33 (FIG. 2). It will be seen from FIG. 2 that this path is so designed that the direction in which the ball is urged to go by gravity must be changed frequently by the operator. The tray 20 is provided with a number of holes 34 which act as hazards. The numbering of these holes is such that for the sake of clarity, only a few of them are designated by number. These holes 34 are large enough to permit the ball to drop through them. They are strategically located to catch the ball 30 unless the operator is sufficiently skillful and careful to manipulate the tray with the necessary dexterity to keep the ball 30 moving along the designated course 33.

Figure 1:
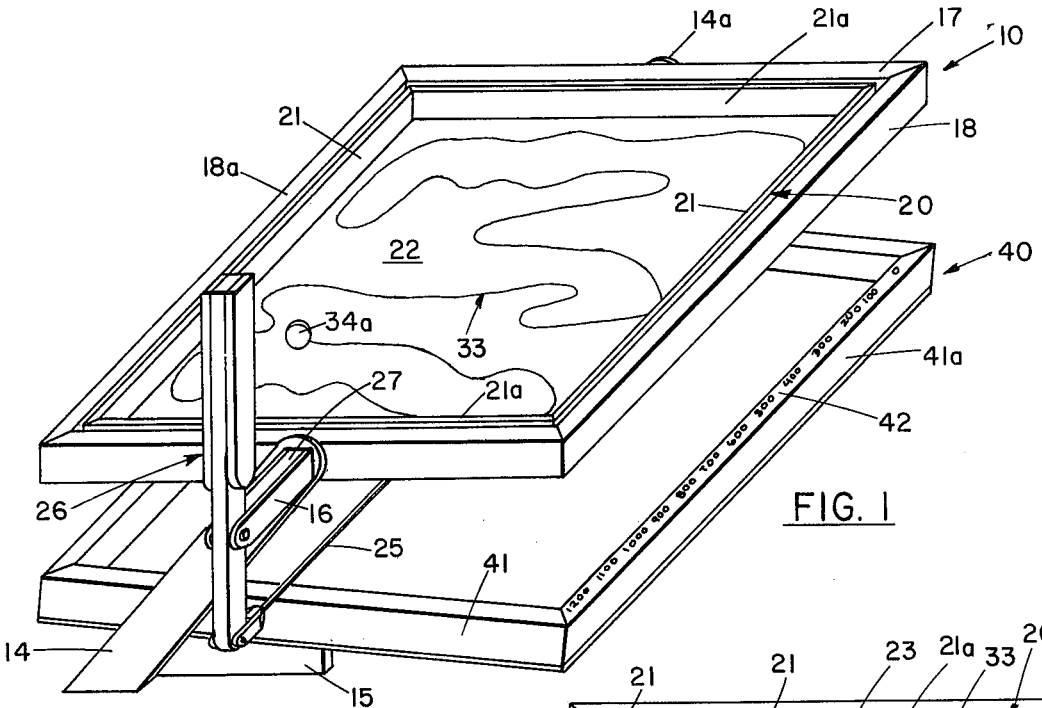
FIG. 1 is an oblique view of the invention illustrating the tray without the ball openings to improve clarity.

Beneath the frame 10 and tray 20 is a forwardly inclined scoring board 40. In a construction utilizing a rectangular upper tray 20, the board 40 is also rectangular. The scoring board is surrounded by a frame 41. The front frame member 41*a* is provided with scoring indicia 42 (FIG. 1) which are graduated in value laterally of the board with the lowest values being beneath the starting pocket 32. The further the operator manages to move the ball before it drops through one of the holes 33, the further across the scoring board the ball will come to rest against the front member 41*a* of the frame and, thus, the higher his score since scoring is done by reading the indicia nearest the ball.

The surface of the scoring board 40 is without obstruction. The ball, upon striking it, is free to roll in any direction. Thus, should the ball have any lateral spin during its fall, this could cause the ball to move somewhat to the left or to the right resulting in a higher or lower score than would be obtained had the ball had no spin when it struck the scoring board.

Should the operator be successful in manipulating the ball to avoid all the barriers 31 and the holes 34 in the tray 20, the designated path 33 will terminate in a hole 34*a* (FIG. 2) through which the ball 30 will drop into the maximum score receptacle 44 which is located to receive and hold any ball dropping through opening 34*a* (FIG. 3). A person placing his ball in receptacle 44 receives a score so high that none of the other players can contend with him.

This invention provides a test and challenge to people of a very wide range of ages. Because it is manipulated by one hand through the handle 27, it is available to the handicapped. At the same time, the invention requires a higher degree of dexterity and concentration because control of the ball in both planes is solely controlled by one hand requiring very precise and delicate manipulation of the handle. Because the score is not positively determined by a designation on the hole 34 through which the ball escapes the tray 20, there is a certain level of chance and thus suspense to the game. Because it is manipulated by a single handle, it provides a degree of dexterity training for younger players which will prove useful to them later in life such as those who may wish to enter the field of aviation. Because the tray is so responsive to hand movement, the game teaches the importance of precise muscular control.

It will be recognized that the various components of the game can be manufactured from various materials. The invention can most advantageously be constructed from wood or assembled from plastic except for the ball which preferably is of steel.

While a preferred embodiment of the invention has been illustrated and described, it will be recognized that modifications of the invention can be made without departing from the principles thereof. Such modifications are to be considered as included in the hereinafter appended claims unless these claims by their language expressly state otherwise.

The embodiments of the invention in which an exclusive property or privilege is claimed are defined as follows:

1. A game of skill having a base, said base having a pair of upstanding standards; a lower tray mounted on said base between said standards; an upper tray and gimbal means supporting said upper tray between said standards and above said lower tray; a handle interconnected to said gimbal means and to said upper tray for rocking said upper tray about said gimbal means; a plurality of openings through said upper tray and a ball movable over the surface of said upper tray of a size to pass through said openings; a line on said upper tray to indicate the path said ball is to follow during play; an element forming a starting pocket at the beginning of said line and one of said openings being at the end of said line, all other ones of said openings being on one side or the other of said line; said lower tray having a planar surface inclined toward one edge over which said ball can freely roll, scoring indicia of graduated values on said one edge with the lowest value adjacent the area of said lower tray beneath the exit of said starting pocket and the highest value adjacent the area at the opposite end of said lower tray wherein a plurality of upstanding barriers are provided at various positions along said line, said barriers being rigidly secured to said upper tray and positioned to interrupt movement of said ball, said barriers consisting of a plurality of spaced sections arranged at various angles to each other, certain of said barriers forming a second pocket open at one side around said one opening for restricting access of said ball to said one opening, said gimbal means including a first and second pivot means, wherein said handle is elongated having an upper grip portion and a lower link connecting portion and its point of attachment to said second pivot means being intermediate said portions, said trays being rectangular, having a pair of sides and a front and a back; said handle being at one side of said trays and said one edge of said lower tray being along the front thereof, wherein a ball trapping pocket is provided on said lower tray aligned with said one opening for receiving said ball when it falls through said opening, said ball trapping pocket being surrounded by a retaining wall such that the sole entrance to said pocket is through said one opening, said ball trapping pocket being located in an area on said lower tray from which said ball would normally roll to a position along said edge having a value intermediate said highest and lowest values.

* * * * *